US009644523B2

(12) United States Patent
Haunstetter

(10) Patent No.: US 9,644,523 B2
(45) Date of Patent: May 9, 2017

(54) DISCOLORATION PROTECTION

(71) Applicant: Dr. Ing. h.c. F. Porsche Aktiengesellschaft, Stuttgart (DE)

(72) Inventor: Frank Haunstetter, Leonberg (DE)

(73) Assignee: DR. ING. H.C.F. PORSCHE AKTIENGESELLSCHAFT, Stuttgart (DE)

( * ) Notice: Subject to any disclaimer, the term of this patent is extended or adjusted under 35 U.S.C. 154(b) by 0 days.

(21) Appl. No.: 14/730,638

(22) Filed: Jun. 4, 2015

(65) Prior Publication Data

US 2015/0267598 A1 Sep. 24, 2015

Related U.S. Application Data

(62) Division of application No. 14/279,392, filed on May 16, 2014, now Pat. No. 9,303,546.

(30) Foreign Application Priority Data

Jun. 19, 2013 (DE) ..... 10 2012 106 415

(51) Int. Cl.

| | |
|---|---|
| ***F01N 13/16*** | (2010.01) |
| ***C25D 9/04*** | (2006.01) |
| ***C25D 11/38*** | (2006.01) |
| ***B05D 3/04*** | (2006.01) |
| ***B05D 7/14*** | (2006.01) |
| ***B05D 3/02*** | (2006.01) |
| ***F01N 3/05*** | (2006.01) |
| ***F01N 13/18*** | (2010.01) |

(52) U.S. Cl.

CPC ..... *F01N 13/16* (2013.01); *B05D 3/0254* (2013.01); *B05D 3/0486* (2013.01); *B05D 7/14* (2013.01); *C25D 9/04* (2013.01); *C25D 11/38* (2013.01); *F01N 3/055* (2013.01); *F01N 13/1805* (2013.01); *Y10T 428/24322* (2015.01)

(58) Field of Classification Search

CPC .... B05D 5/00; B05D 7/14; B05D 7/16; F01N 13/1805; F01N 13/1827; F01N 2260/20; F01N 2340/04; F01N 2510/08

USPC ..... 60/320, 323, 324; 427/372.2

See application file for complete search history.

(56) References Cited

U.S. PATENT DOCUMENTS

| | | | | |
|---|---|---|---|---|
| 5,590,524 | A | 1/1997 | Moore, III et al. | |
| 2007/0238257 | A1* | 10/2007 | Paar | C09D 5/10 438/305 |
| 2012/0009340 | A1* | 1/2012 | Sepeur | C09D 5/10 427/180 |
| 2012/0186894 | A1* | 7/2012 | Schmidt | F01N 13/001 180/309 |

(Continued)

OTHER PUBLICATIONS

Nanotechnologien im Automobil. In: S. 17 Aktionslinie Hessen-Nanotech, 3, 2008, 15-19.

(Continued)

*Primary Examiner* — Jorge Leon, Jr.

(74) *Attorney, Agent, or Firm* — Gerald E. Hespos; Michael J. Porco; Matthew T. Hespos

(57) ABSTRACT

A device is provided for protecting at least one metallic surface against discolorations under the action of heat. The device includes a metallic surface with a lacquer applied a lacquer applied thereto to the metallic surfaces and then stoving the metallic surface while sealing the metallic surface against oxygen contact to form a permanently effective oxygen barrier.

5 Claims, 2 Drawing Sheets

(56) References Cited

U.S. PATENT DOCUMENTS

2012/0247861 A1* 10/2012 Mizuno ..... B60K 13/04
180/296

OTHER PUBLICATIONS

Bobzin, Kirsten: Oberflachentechnik fur den Maschinenbau, Weinheim: Wiley-VCH, 2013. 150-158.—ISBN 978-3-527-33018-8.
Inox-Color: Farbe. Form. Edelstahl. S. 20-21 Gebaudehullen aus legiertem Stahl. In: Baumetall, 25, 2010, 3, S. 20-21.
Kirsten Bobzin: Oberflachentechnik fur den Maschinenbau. Weinheim: Wiley-VCH, 2013. 65-125. ISBN 978-3-527-33018-8.

* cited by examiner

DISCOLORATION PROTECTION

CROSS REFERENCE TO RELATED APPLICATIONS

This application is a divisional of U.S. patent application Ser. No. 14/279,392, filed May 16, 2014, which claims priority under 35 USC 119 to German Patent Appl. No. 10 2013 106 415.9 filed on Jun. 19, 2013 and German Patent Appl. No. 10 2014 105 619.1 filed on Apr. 22, 2014, the entire disclosures of which are incorporated herein by reference.

BACKGROUND

1. Field of the Invention

The present invention relates to a method for treating at least one metallic surface for protection against thermally induced discolorations and to a covering, treated by means of the method according to the invention, for an exhaust system.

2. Description of the Related Art

Exhaust systems or parts, particularly metallic parts, that contact an exhaust system may discolor due to high temperatures in the respective exhaust system, and, for example, rainbow-like patterns may form.

Complicated work, such as, rubbing down, polishing and painting is necessary to eliminate this effect and to restore an original coloring. Unfortunately, such work does not prevent the effect from recurring, and therefore renewed discoloration in the event of renewed heating has to be expected.

Against this background, a method for protecting at least one metallic surface against discolorations is presented, in which the at least one metallic surface is treated with a suitable clear lacquer. Clear lacquers of this kind are already known from the prior art and are offered, for example, under the trade name of NANO-X clear lacquer. After the method has been carried out, the clear lacquer forms a permanently effective oxygen barrier between the metallic surface and the hot exhaust gases of the exhaust system that flow over the metallic surface. Thus, the visual appearance of the metallic surface is not impaired. The oxygen barrier is composed of nanoparticles that form an oxygen-tight envelope that keeps oxygen away from the metal surface lying underneath and the discoloration of the metallic surface at high temperatures is prevented.

What has not yet been solved to date is that the metallic surface is damaged and discolored at the high temperatures prevailing in the stoving furnace.

It is proposed, in this regard, to seal the metallic surface against oxygen contact. This sealing may take place in various ways.

Thus, stoving may be carried out under a protective atmosphere. The term "under a protective atmosphere" is to be understood in the context of the present invention to mean treatment of the metallic parts in a closed space, for example in a stoving furnace, in which specific conditions are generated by means of selected gases. In particular, a protective atmosphere composed of nitrogen is capable of being used for the purpose of the displacement of oxygen.

Alternatively, there may be provision for subjecting the metallic surface to what is known as an INOX spectral method before the application and stoving of the clear lacquer. In this known electrochemical process, the metallic surface acquires coloring caused by the build-up of a chromium oxide layer. It was shown, surprisingly, that this effect hardens the metallic surface against oxygen contact in such a way that the stoving of the clear lacquer no longer has to take place under a protective atmosphere.

For both variants outlined above, it is recommended to carry out pretreatment of the metallic surface, for example by blasting with blasting stock and subsequent electropolishing. The blasting stock can in this case have a granulation of, in particular, 90 to 150 μm.

SUMMARY OF THE INVENTION

The invention relates to a method that enables the clear lacquer to be stoved at a suitable temperature.

As a result of the stoving process, the clear lacquer binds effectively with the metallic surface or with the electrochemically pretreated metallic surface and is consequently less sensitive to mechanical and chemical influences. A possible suitable temperature for the process of stoving the clear lacquer is in the range of 300° C. to 500° C. However, lower or higher temperatures can be used with some lacquers or clear lacquers. It was shown that the best results occur at a temperature of a magnitude of 450° C.

The method may use a NANO-X as a clear lacquer with an oxygen barrier.

The method employs nanotechnology to set up an oxygen barrier above the at least one metallic surface. The oxygen barrier is impermeable to oxygen and consequently has a protective action against discolorations at high temperatures on the at least one metallic surface.

The invention may also comprise a covering in the region near an exhaust tract that branches off from an internal combustion engine. The hot exhaust gases flowing out flow onto a covering of this kind, so that the covering itself is exposed to very high thermal loads. The covering is treated at least partially after the method of the invention.

The covering of the invention makes it possible to shield outwardly an engine space having an internal combustion engine located in it without the risk of discoloration. A covering of this kind or a covering treated in this way makes it possible to integrate exhaust systems into a body of a vehicle in a visually attractive way and with harmonious coloring.

Integrating an exhaust system harmoniously according to the invention into the body of a respective vehicle allows novel functionalities, such as, shortened exhaust gas distances and, among these, a reduced discharge of heat to the vehicle.

Further advantages and refinements of the invention may be gathered from the description and the accompanying drawings.

It is self-evident that the features mentioned above and those yet to be explained below can be used not only in the combination specified in each case, but also in other combinations or alone, without departing from the scope of the present invention.

DETAILED DESCRIPTION OF THE PREFERRED EMBODIMENTS

Figure 1:
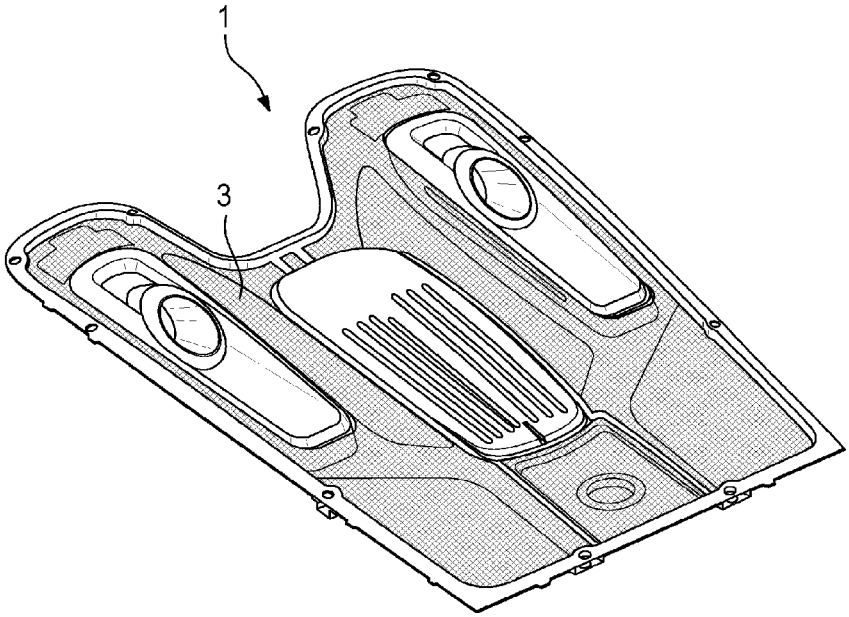
FIG. 1 is an overall illustration of a possible embodiment of the device.

A covering 1 illustrated in FIG. 1 covers or protects an exhaust system or an engine space comprising an exhaust system and an internal combustion engine against external influences.

The covering 1 absorbs exhaust gases emerging from the internal combustion engine or the exhaust system. For this purpose, the exhaust gases generated by the internal combustion engine flow over the covering, which discharges them into the respective surroundings.

Furthermore, the covering 1 functions to remove heat from the internal combustion engine. Orifices 3 are formed in the covering 1 for heat removal and preferably are in the form of hexagonal holes. The orifices 3 allow air exchange between the engine space located under the covering and the surroundings. Air heated by the internal combustion engine rises up in the direction of the covering 1, passes through the covering 1 via the orifices 3 and is discharged into the surroundings. At the same time, the discharge of the heated air causes an ingress of cold ambient air into the engine space.

The covering 1 makes it possible to arrange an exhaust system in a vehicle so that the exhaust gases are expelled up and away from the road. The covering therefore is configured to be connected to a respective exhaust system and to absorb exhaust gases emerging from the respective exhaust system and to discharge them into the surroundings.

The exhaust gases delivered by the exhaust system usually are very hot. Accordingly, at least those parts of the covering 1 that contact the exhaust gases are formed from a temperature-resistant material so that the heat can be absorbed and discharged. The corresponding parts of the covering 1 preferably are pretreated by blasting with blasting stock and, if appropriate, by subsequent electropolishing. The covering 1 may be treated initially with what is known as an INOX SPECTRAL® method. In this known electrochemical process, the metallic surface of the covering acquires coloring due to the build-up of a chromium oxide layer. It was shown, surprisingly, that this effect hardens the metallic surface against oxygen contact in such a way that the subsequent stoving of the clear lacquer no longer has to take place under a protective nitrogen atmosphere. The clear lacquer used may be a clear nano-lacquer with an oxygen barrier, such as a NANO-X clear lacquer, for example a NANO-X clear lacquer AFP 1563. This lacquer then is stoved at a stoving temperature of approximately 450° C.

Insofar as an oxygen barrier is not generated by a corresponding method, such as the INOX spectral method, before the application of the clear lacquer, the clear lacquer is stoved under a protective atmosphere, such as, for example, nitrogen, preferably at a temperature of 450° C.

The heat-resistant layer also may be formed solely by application of a nano-clear lacquer with an oxygen barrier on a respective part of the covering and subsequent stoving under a protective atmosphere. Moreover, a PVD layer (physical vapor deposition) also may be provided as a heat-resistant layer. The type of layer selected depends on the relevant part of the covering and also on its desired visual impression.

Figure 2:
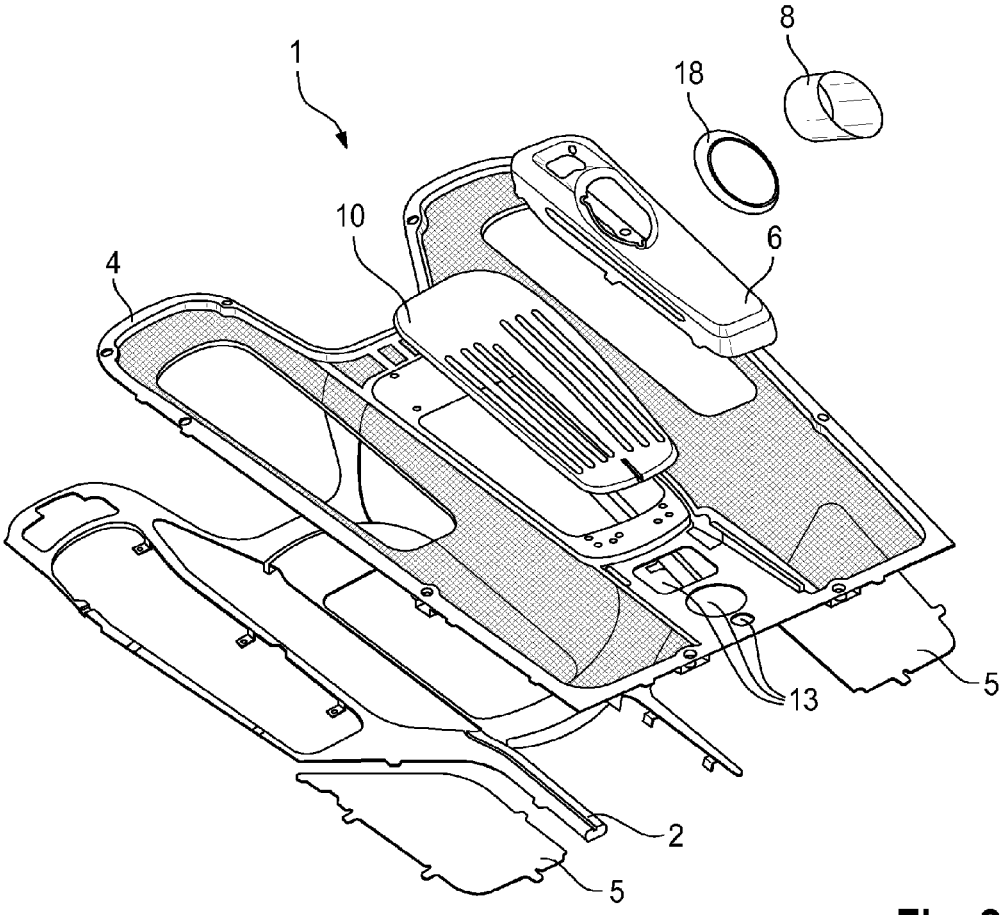
FIG. 2 is an exploded drawing with respective components of the device of FIG. 1.

The overview, illustrated in FIG. 2, of the components of the covering 1 affords a possibility for a detailed explanation of the construction of the covering 1.

A basic skeleton composed of an inner panel 2 and an outer panel 4 carries further components. The outer panel 4 initially is treated by the INOX SPECTRAL method, using an embodiment of the method of the invention, and subsequently is painted with a clear lacquer. The inner panel 2 is painted only with a clear lacquer. The outer panel 4 subsequently is stoved under an air atmosphere in a stoving furnace, while the inner panel 2 treated only with clear lacquer is stoved under a protective atmosphere of nitrogen at approximately 450° C. in a stoving furnace. The clear lacquer preferably is a nano-clear lacquer, in particular a nano-clear lacquer with an oxygen barrier.

The further components include paired diaphragms 6 of the exhaust system, only one of which is illustrated for reasons of clarity. Ring diaphragms 8, 18 are inserted into each diaphragm 6, and a covering 10 for a catalytic converter of the exhaust system is arranged centrally on the outer panel 4. The covering 10 for the catalytic converter is delimited downward by a service cover (not illustrated). The service cover conceals access or ingress formed by orifices 13 to the internal combustion engine arranged beneath the covering 10. The inner panel 2 carries two inner covers 5 that are impermeable to air and moisture and shield respective regions beneath the inner covers against, for example, climatic influences. Both the diaphragms 6 of the exhaust system and the covering 10 for the catalytic converter may be composed of ceramic or of a composite ceramic material.

Parts of the covering, such as the diaphragms 6, that contact the exhaust gases are configured to discharge the exhaust gases or an exhaust gas jet thereof into the surroundings in a defined direction, for example opposite to the direction of travel.

The covering 1 enables an efficient reduction of heating of the engine space and therefore of an entire vehicle caused by operation of the internal combustion engine. A temperature lowering or stabilization achieved thereby may be important for the use of heavy-duty accumulators, since these often attain optimal efficiency in the range of 20 to 40° C. Thus, the covering of the invention enables the engine space to be used as a storage space for accumulators, for example, for a hybrid drive.

The method of the invention provides vehicle components that are resistant to high temperature and that also have a desirable outwardly visible appearance.

What is claimed is:

1. A device for discharging exhaust gases and waste heat of an internal combustion engine of a vehicle, the device comprising: a covering for an engine space in which the internal combustion engine is arranged; at least one exhaust tract branching off from the internal combustion engine and connected from the internal combustion engine upward to the covering over substantially a shortest possible distance so that the exhaust gases are dischargeable into surroundings of the vehicle via the covering, wherein the covering has a first surface on a first metallic material above the internal combustion engine and a second surface on a second metallic material disposed above the first metallic material, at least part of the first metallic material being substantially impermeable to air and moisture and at least parts of the second metallic material being formed with a plurality of openings therethrough for permitting an upward flow of heat away from the engine, a lacquer applied to the first and second metallic surfaces and sealing the first and second metallic surface against oxygen contact and the sealed metallic surface with the lacquer thereon being stoved to form a permanently effective oxygen barrier that prevents the first and second metallic materials from discoloring when exposed to the exhaust gas and the heat of the internal combustion engine.

2. The device of claim 1, wherein the lacquer is a clear lacquer stoved at a stoving temperature of 450° C.

3. The device of claim 2, wherein the clear lacquer is a NANO-X clear lacquer with an oxygen barrier.

4. A vehicle comprising:

an internal combustion engine that produces a heated exhaust gas;

an exhaust system component that accommodates a flow of the heated exhaust gas from the internal combustion engine and directs the heated exhaust gas from the vehicle in a direction up and away from a road on which the vehicle is disposed;

a covering disposed at least partially above the internal combustion engine and the exhaust system component and being integrated into an outer body area of the vehicle, the covering having a first surface on a first metallic material above the internal combustion engine and a second surface on a second metallic material disposed above the first metallic material, at least part of the first metallic material being substantially impermeable to air and moisture and at least parts of the second metallic material being formed with a plurality of openings therethrough for permitting an upward flow of the heated exhaust gas away from the engine having an array of orifices therethrough that permit the heated exhaust gas and heat from the internal combustion engine to flow up and escape from the vehicle through the orifices and into ambient surroundings, the covering having a clear lacquer applied to the first and second metallic surfaces, the clear lacquer having an oxygen barrier therein for sealing the first and second metallic surface from oxygen contact thereby forming a permanently effective oxygen barrier that prevents the first and second metallic surfaces from discoloring when exposed to the heated exhaust gas and the heat of the internal combustion engine.

5. The vehicle of claim 4, wherein the exhaust system component extends along substantially a shortest possible distance from the internal combustion engine to the covering.

* * * * *